United States Patent [19]

Rebel

[11] Patent Number: 4,719,334

[45] Date of Patent: Jan. 12, 1988

[54] CONNECTION INSTALLATION FOR A CORDLESS ELECTRIC APPLIANCE

[75] Inventor: Joachim Rebel, D-Reinchenbach/Fils, Fed. Rep. of Germany

[73] Assignee: Geka-Werk Reinhold Klein AG, Gemuedenl, Fed. Rep. of Germany

[21] Appl. No.: 754,435

[22] Filed: Jul. 12, 1985

[30] Foreign Application Priority Data

May 17, 1985 [DE] Fed. Rep. of Germany ..... 3517830

[51] Int. Cl.[4] ..... H05B 1/02; D06F 75/28; D06F 79/02; H01R 33/96

[52] U.S. Cl. ..... 219/518; 38/107; 38/142; 200/51.09; 219/247; 219/259; 248/117.2; 339/40; 339/43

[58] Field of Search ..... 219/246, 247, 245, 259, 219/518; 335/205, 206; 200/51.09; 38/79, 96, 107, 142, 75; 339/40, 43; 248/117.1–117.5

[56] References Cited

U.S. PATENT DOCUMENTS

| | | | |
|---|---|---|---|
| 1,421,588 | 7/1922 | Shirk et al. | 219/247 |
| 1,421,589 | 7/1922 | Shirk et al. | 219/247 |
| 1,421,850 | 7/1922 | Shirk et al. | 219/247 |
| 1,426,015 | 8/1922 | Shirk et al. | 219/247 |
| 3,144,527 | 8/1964 | Tolegiam | 200/51.09 |
| 3,398,260 | 8/1968 | Martens | 219/518 X |
| 3,637,986 | 1/1972 | Laing | 219/518 X |
| 3,760,149 | 9/1973 | Harsanyi | 219/518 X |
| 4,096,545 | 6/1978 | Helwig | 200/51.09 X |
| 4,317,969 | 3/1982 | Riegler et al. | 335/205 X |
| 4,528,429 | 7/1985 | Dobson et al. | 200/51.09 X |
| 4,650,268 | 3/1987 | Dobson et al. | 339/40 X |
| 4,655,523 | 4/1987 | Rebel | 339/40 |

FOREIGN PATENT DOCUMENTS

| | | | |
|---|---|---|---|
| 126944 | 2/1948 | Australia | 219/247 |
| 580709 | 7/1933 | Fed. Rep. of Germany . | |
| 2036268 | 1/1972 | Fed. Rep. of Germany . | |
| 7105435 | 5/1972 | Fed. Rep. of Germany . | |
| 2212228 | 9/1973 | Fed. Rep. of Germany . | |
| 1229442 | 9/1960 | France . | |
| 595573 | 12/1947 | United Kingdom . | |
| 618278 | 2/1949 | United Kingdom | 219/247 |
| 623307 | 5/1949 | United Kingdom | 219/247 |
| 1283003 | 7/1972 | United Kingdom | 200/51.09 |

*Primary Examiner*—Anthony Bartis

*Attorney, Agent, or Firm*—Roylance, Abrams, Berdo & Goodman

[57] ABSTRACT

An electrical connection installation for a cordless electric appliance, such as a flatiron, has an electrical contact part carried by a stationary base serving as a stand for the appliance and which is adapted to mate with the electrical contacts of the appliance when the appliance is placed on the base. The contact part is coupled to an electric power source in in the base by a switch having a pair of contacts normally biased to an open position by springs formed from curved sheet metal strips and which are closed by a magnetically reactive contact actuating member responsive to the proximity of a permanent magnet in the appliance when the appliance is placed on the base. The switch contacts, contact actuating member, contact part and appliance contact are so designed and arranged that the contact part and appliance contacts are in engagement before the switch contacts are closed upon placement of the appliance on the base and the switch contacts are opened before the separation of the contact part and appliance contacts upon removal of the appliance from the base.

17 Claims, 3 Drawing Figures

CONNECTION INSTALLATION FOR A CORDLESS ELECTRIC APPLIANCE

FIELD OF THE INVENTION

The present invention relates to a connection installation for a cordless electric appliance to couple the appliance to an electrical power source.

BACKGROUND OF THE INVENTION

This application is related to applicant's U.S. patent application Ser. No. 754,434 filed July 12, 1985, now U.S. Pat. No. 4,655,523, and entitled "Stand for Cordless Electric Appliance", the subject matter of which is hereby incorporated by reference.

In a known appliance, a stand for the electric appliance is configured as a connection installation. The bottom of the stand is pivotable and carries a contact which interacts with another contact mounted on the base of the stand. This known arrangement is disclosed in French Pat. No. 1,229,442.

SUMMARY OF THE INVENTION

An object of the present invention is to provide a connection installation for a cordless appliance which operates quickly when the appliance is lifted from the installation stationary base and when it is replaced on the base.

Another object of the present invention is to provide a connection installation for a cordless appliance which is simple and safe to operate.

The foregoing objects are obtained by a connection installation for a cordless electrical appliance, comprising a connector for engaging and forming an electrical connection with a cordless appliance contact, a switch selectively connecting and disconnecting the connector to a source of electrical power and a contact member for operating the switch in response to presence or absence of the cordless appliance. The switch includes first and second switch contacts which are relatively movable between a first position in which the switch contacts are engaged and a second position in which the switch contacts are separated or disconnected. The switch contacts are biased toward the first or the second position. The contact member is coupled to the switch contacts, moves the switch contacts to the other of its positions against the biasing force, and includes a reaction member for moving the contact member in response to the proximity of a magnet in the cordless appliance.

When the electric appliance is lifted from the connection installation, the appliance magnet is removed from the proximity of the contact member. The contact member is then drawn downwardly under the effect of the biasing to disconnect the switch contacts. The contact member can be configured so that the installation connector is disconnected from the power source while the electrical contacts of the electric appliance are still in engagement with the installation connector. With the placement of the electric appliance on the connection installation, the magnet comes so close to the contact member that it is certain to be raised.

The use of switch springs on a housing to bias the switch contacts avoids the use of special attachment members. The switch springs can be detachably attached to the housing.

The use tension and compression springs to bias the switch contacts and the use of a connection member coupling the tension spring to the contact member simplies the configurations of the switch springs. One can be connected with the contact member without use of an additional connection member.

The support for the first switch contact, the first switch spring and the connection member permits these features to be formed in a single element configuration. This enables the switch springs to be manufactured separately at low cost by a cutting and shaping process carried out in large batches in mass production.

The second switch spring can be made integral with its holder and the installation connector to reduce manufacturing costs.

An automatically operating the safety mechanism for the installation connector can provide protection against unintentional electric connection by inserting a plug or the like into the installation housing.

The contact member can include a magnetizable contact part which moves in response to a permanent magnet.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF PREFERRED EMBODIMENT

Figure 1:
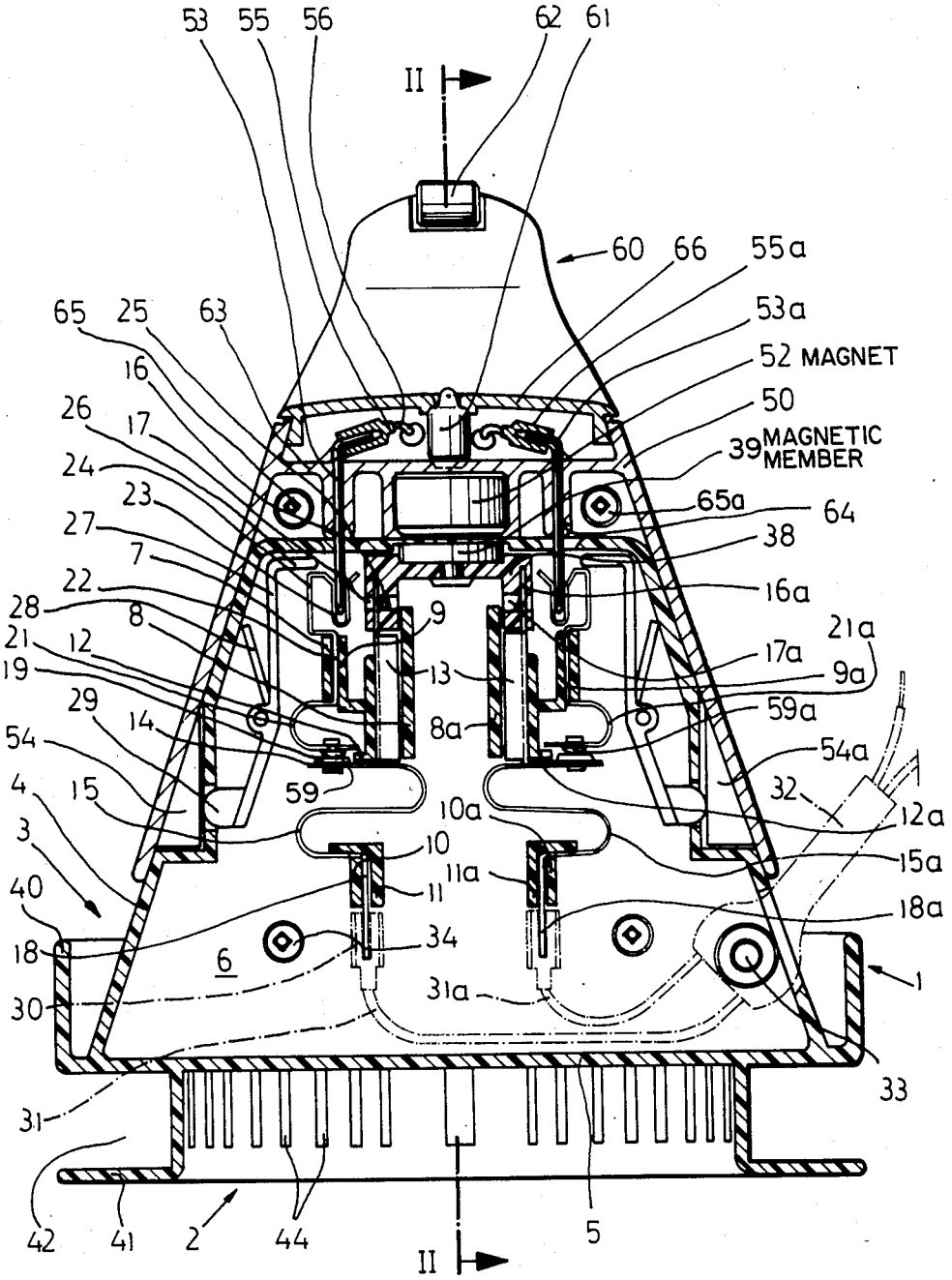
FIG. 1 is a rear elevational view in section of a connection installation and cordless appliance according to the present invention.

Referring to the drawings, a stand 1 has a base 2 and a connection installation 3. An installation housing 4 is arranged in base 2 perpendicular to bottom member 5. Base 2 and housing 4 are of a heat-resistant, electrically insulating material, generally plastic.

Housing 4 is configured essentially as a truncated pyramid. The front wall 6 is flat and perpendicular to base bottom member 5. Fastener projections 7 to 11 extend perpendicularly from front wall 6 on its side away from base 2 and form an integral one-piece construction with front wall 6. Fastener projections 7 and 8 are essentially plate-like members and are parallel with projection 8 being longer than projection 7. Fastener projection 9, located between projections 7 and 8, is essentially U-shaped. Each of the arms of projection 9 is arranged at some distance from fastener projections 7 and 8. The right arm of projection 9 extends downwardly and has a stop 12 projecting to the left as view in FIG. 1 of the drawing. Fastener projection 10 is generally identical to fastener projection 7. Fastener projection 11 is L-shaped and is arranged at some distance from projection 10. Fastener projections 7 to 11, as described hereinafter, are all configured as mounting parts.

A connection part or member 13 is U-shaped in transverse cross section and is located between fastener projections 8 and 9. A contact support flange 14 extends at a right angle to connection member 13 and is configured unitarily with connection member 13. An S-shaped first switch spring 15 is formed as a unitary extension of connection member 13. An attachment part 16 at the top of connection member 13 has a stopping flange or stop device 17 bent outwardly. The relatively great length of switch spring 15 lessens fatigue. Contact flange 14 supports a first switch contact stud 19. Contact flange 14 and stopping flange 17 are narrower than the middle part of connection part 13 or attachment part 16.

The first switch spring 15 is a tension spring and has a connection part 18 angled downwardly and rearwardly on its bottom. Connection part 18 and the bottom of first switch spring 15 are held by fastener projections 10 and 11, as though through a slit.

A U-shaped second switch spring 21 carries a second switch contact stud 59 at its free end. A holder 22 is arranged on one of the U-shaped switch spring arms, and is fixed between fastener projections 7 and 9. A U-shaped bushing or connector 23 is formed integrally or unitarily at the top end of holder 22 by an essentially U-shaped spring part 24. Bushing 23 is widened at its upper end.

Parts 13 to 18 and parts 21 to 24 are all of one piece. They are each manufactured of a flexible, current-conductive material, and can be formed with mirror-image symmetry to permit them to be reversed. Connection part 13 and first switch spring 15 could also be composed of several parts. For instance, connection part 13 and switch spring 15 could be formed of different materials and as individual parts which are subsequently connected together.

A through bore 25 is found in a horizontal part of installation housing 4 over bushing 23. Bore 25 can be closed by a protection part 26 locatable between bushing 23 and through bore 25. Protection part 26 is a portion of a double-arm lever 27 pivotably mounted on a journal having one end thereof mounted on front wall 6. A safety spring 28 is formed as a unitary piece with safety lever 27 and abuts installation housing 4 to bias safety lever 27 in clockwise direction as viewed in the drawing. A contact member 29, arranged on the lower arm of safety lever 27, projects outwardly of installation housing 4 when protection part 26 is in a closed or safety position. Contact member 29 serves as a handle.

Parts 7 to 29 are in the left side of housing 4 as shown in the drawing. Corresponding mirror-image identical parts are provided on the other side of the housing with the same numbers and with the addition of reference suffix a. Only one reference numeral with or without a letter is given for any two identical parts to save space in the drawing.

A U-shaped contact actuating member 38 of electrically insulating material is mounted with both of its arms on attachment parts 16 and **16*a*. The contact actuating member arms have holes which mate with stopping flanges 17 and 17*a*. In its middle, contact actuating member 38 carries a responsive contact part or actuating member 39 of magnetizable material with as small as possible residual magnetism. Contact part or actuating member 39 projects into a cutout on the bottom surface of the top part of housing 4**.

A cable 31, as shown in broken lines, is attached to connection 18, by a connection clamp 30. Cables 31 and **31*a* are guided to the outside through a piece of elastic tubing 32 attached to front wall. Tubing 32 is pivotally mounted for movement about a horizontal axis by an attachment member 33. Cables 31 and 31*a*** are connected with a connector plug.

A housing cover 35 is placed on the back or rear of housing 4 and has projections **36*a* and 37*a* on its inside surface projecting into the housing. Projection 36*a* rests on fastener projections 7*a* to 9*a*, while projection 37*a* rests on fastener projections 10*a* and 11*a*. Each cover projection forms an abutment for the parts inserted between fastener projections 7*a* to 11*a*. The clearances between the fastener projections are closed by the cover projections. Fastener projections 7 to 11 are likewise closed by projections 36*a* and 37*a* which extend over the entire width of cover 35**.

Figure 2:
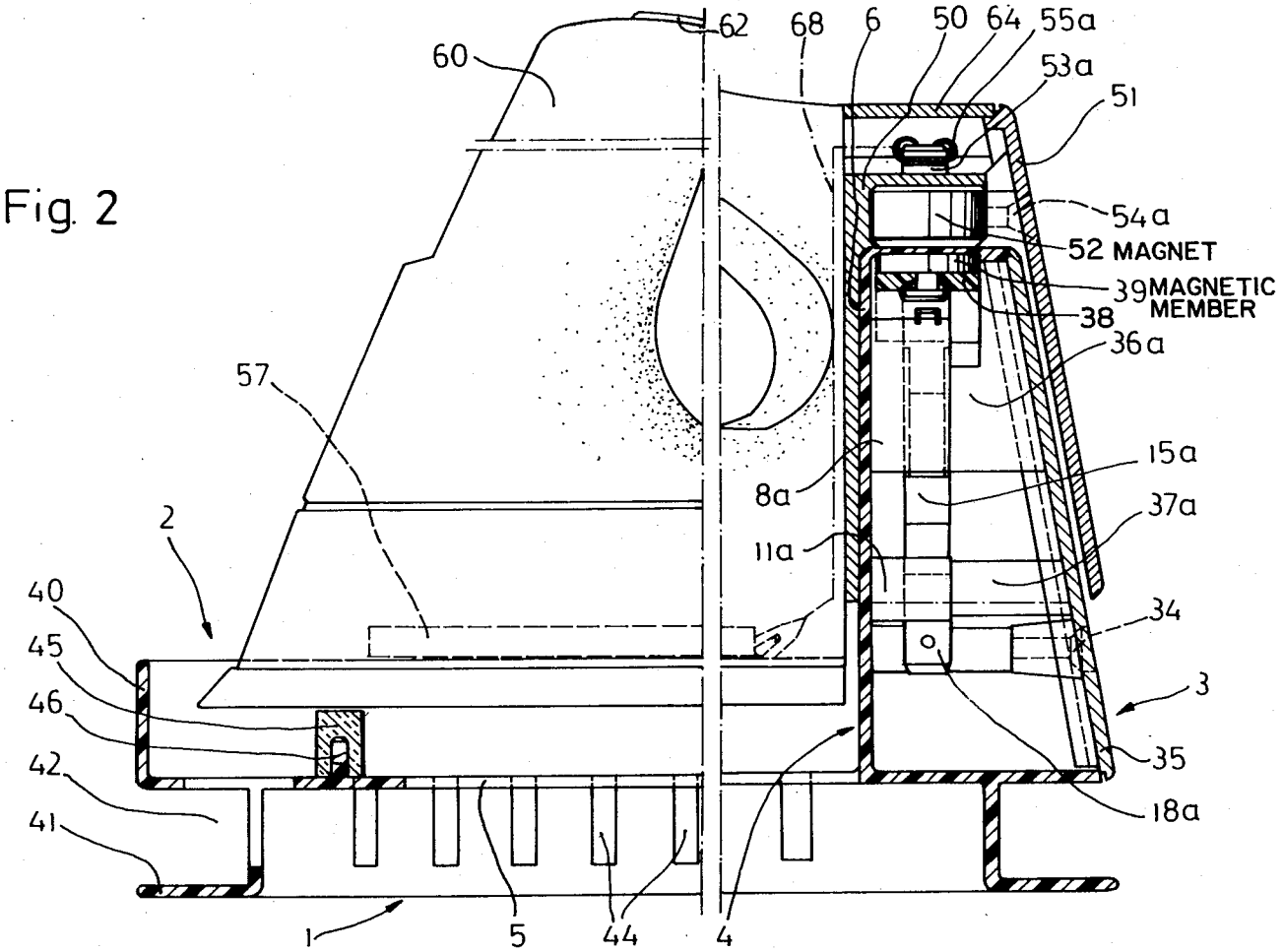
FIG. 2 is a side elevational view in section of the connection installation and cordless appliance taken along line II—II of FIG. 1.

Base 2 is essentially in the shape of a base plate for the flatiron 60, and has an edge strip 40 projecting over and surrounding its bottom member 5. Edge strip 40 surrounds flatiron 60 when it is in rest position. Strip 40 is spaced at some distance from bottom member 5. A base 41 depends from bottom member 5. Base 41 and bottom member 5, as seen in the transverse section of FIG. 2, define a U-shaped hollow space 42. Bottom member 5 has a middle open space 43 which is somewhat smaller than the base plate of flatiron 60, and has a series of oblong ventilation openings 44 around its edge. Openings 44 extend under and beyond a flatiron 60 placed on base 2.

Figure 3:
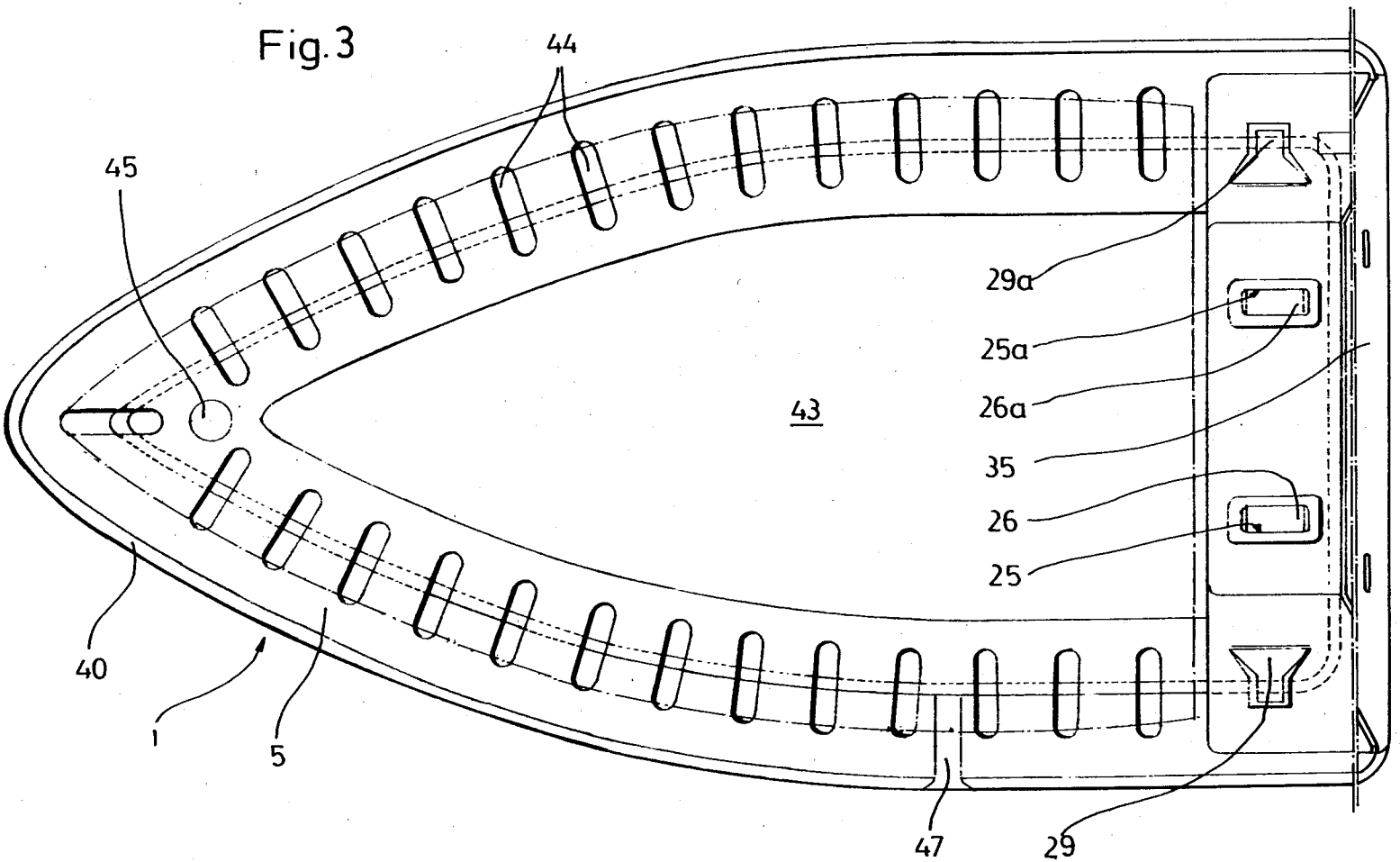
FIG. 3 is a top plan view of the connection installation without the cordless appliance.

A quadratic, cylindrical support member 45 of heat-resistant material, especially a ceramic stone (e.g., steatite), is mounted on bottom member 5. Support member 45 is adapted in shape to the bottom of flatiron 60, and is held by an attachment pin 46 integrally formed with bottom member 5 and projecting upwardly. Support member 45 is lower than edge strip 40, and supports the bottom edge of flatiron 60. Strip 40 and bottom member 5 have a radial recess 47 extending into hollow space 42 in the vicinity of connection installation 3 (FIG. 3). Hollow space 42 serves as a compartment for a cable connecting with cables 31 and **31*a*. The connecting cable is guided through the handle of flatiron 60 and through recess 47 into hollow space 42, in which it is stored and wound up. The free end of the cable can be inserted into recess 47** beneath the plug and held there.

Flatiron 60 is provided with a control switch 62, and temperature control, and a molded part 50 adapted to housing 4. Molded part 50 provided with a removable rear wall 51 on its side away from front wall 6 of housing 4. A disk-shaped permanent magnet 52 is mounted in a pocket in a transverse wall 63 open at the bottom and toward the rear wall 51 in molded part 50. Magnet 52, when arranged in the position illustrated in FIGS. 1 and 2 over contact actuating member 38, forms a currentless relay with contact part 39. A narrow clearance is present between permanent magnet 52 and contact part 39 to prevent the attraction and adherence of the magnet parts.

Plug contacts 53 and **53*a* of electrically conductive material are mounted on each side of permanent magnet 52 in molded part 50. The plug contacts pass through through bores 25 and 25*a* and engage bushings 23 and 23*a*. Each plug contact 53, 53*a* rests in a bushing below transverse wall 63** and is supported by flanges at the top and bottom. Instead of the flanges forming the connection, a form-locking connection or mating shapes of the plug contacts and the molded part or the like can also be used.

Rear wall 51 is connected with molded part 50 by screws 65 and **65*a*. A projection, corresponding to projections 36 and 37, is found between screws 65 and 65*a*** on rear wall 51, which projection securely holds permanent magnet 52 in front wall 6.

The truncated pyramidal internal shape of molded part 50 mates with installation housing 4. Housing 4 has recesses on its bottom for contacts 54 and 54a projecting from molded part 50 into the installation housing recesses. Contacts 54 and 54a interact with contact parts 29 and 29a of the safety levers 27 and 27a. Plugs 53 and 53a are connected through clamps 55, lines 56 and lines 68 with an electric heater 57 in flatiron 60.

The space in molded part 50 receiving contact clamps 55 and 55a is closed at the top by a cover 66 inserted into molded part 50 from the side. For this purpose, cover 66 has dovetailed side guide parts. A fluorescent lamp 61, which can be seen from above, rests in cover 66, and is illuminated when flatiron 60 is connected with the current source.

Molded part 50 rests on installation housing 4 in such a manner that a clearance is left between the bottom of flatiron 60 and bottom member 5 of base 2. The bottoms of the flatiron and base preferably extend parallel. Ventilation openings 44 allow air to pass from hollow space 42 into the intermediate space between flatiron 60 and the edge strip 40 of base 2. Strip 40, overlapping the base plate of flatiron 60, protects against contact and scalding during use of a steam iron.

When flatiron 60 is removed from stand 1, plugs 53 and 53a are removed from bushings 23 and 23a, i.e. the contacts are disconnected from each other. Before the contacts are disconnected from each other, the magnetizing force of the permanent magnet 52 is removed and contact actuating member 39 drops rapidly downward until it stops at fastener projections 8 and 8a, as a result of the force of switch springs 15, 15a, and 21, 21a, breaking the connection with the current source. The prebiased second switch springs 21 and 21a move until their free ends engage stops 12 and 12a. This provides a high break speed for the contact studs 19 and 59, serving as switch contacts.

After plug contacts 53 and 53a are removed from through bores 25 and 25a, protection parts 26 and 26a protect bores 25 and 25a by closing them to the outside. Since contact projections 54, 54a have left the stops 29, 29a of safety levers 27 and 27a, the safety levers move to the closed position.

When flatiron 60 is placed on stand 1, the rear wall of molded part 40 slides along front wall 6 of the connection installation 3. Through bores 25 and 25a are freed by movement of safety levers 27 and 27a so that plugs 53 and 53a pass through bores 25 and 25a and engage bushings 23 and 23a. At the same time, contact part 39 is pulled against the tension force of first switch springs 15 and 15a and the force of lifting second switch springs 21 and 21a from stops 12 and 12a, producing the electric connection between flatiron 60, connection installation 3 and the power source.

While a particular embodiment has been chosen to illustrate the invention, it will be understood by those skilled in the art that various changes and modifications can be made therein without departing from the scope of the invention as defined in the appended claims.

What is claimed is:

1. A connection installation for a cordless electric appliance, comprising:

connector means for engaging and forming an electrical connection with an electric power input terminal of a cordless electric appliance over a certain separation distance of the electric appliance in a direction away from said connector means;

power means providing a connection of said connector means to a supply of electrical power;

switch means, coupled between said connector means and said power means, for selectively electrically connecting and disconnecting said connector means from said power means, said switch means including first and second switch contacts relatively movable between a first position in which said contacts are engaged and a second position in which said contacts are separated;

biasing means, including first and second switch springs formed of curved strips of sheet metal coupled to said first and second switch contacts, respectively, for applying a force to said switch contacts towards said second position, one of said switch springs being a compression spring and the other of said switch springs being a tension spring; and a contact actuating member, coupled to said switch contacts, for moving said switch contacts against said biasing means to said first position, said contact actuating member including magnetic reaction means for moving said contact actuating member against said biasing means in response to proximity of a magnet in the cordless appliance, said certain separation distance being greater than a distance at which proximity of the magnet in the appliance to said magnetic reaction means is sufficient to cause said contact actuating member to move said switch contacts to said first position against the force of said biasing means as the appliance is moved toward and away from said connector means, whereby the switch contacts are in said first position only after coupling of said connector means with the electric power input terminal of the appliance and said switch contacts move to said second position while said connector means still engages the electric power input terminal of the appliance.

2. A connection installation according to claim 1 wherein said switch springs are mounted in a housing of electrically insulating material by holders, and are held by abutments on a housing cover of said housing.

3. A connection installation according to claim 1 wherein said first switch spring comprises a tension spring connected with a connection member, said connection member being connected to said contact actuating member by a stop device and being mounted adjacent said first switch contact, said contact actuating member being guided for movement in a housing; and said second switch spring comprises a compression spring biased against a fixed stop in said second position.

4. A connection installation according to claim 3 wherein said first switch spring and said connection member are integral, said connection member having a guide part in said housing which is U-shaped in transverse cross section and having a flexible flange connecting said connection member to said contact actuating member, said first spring having a contact flange supporting said first contact and extending from said connection member, and having a flexible portion curved in an S-shape.

5. A connection installation according to claim 3 wherein said second switch spring comprises a holder part mounted in said housing and a contact part forming said connector means and formed as one piece with said holder part; and a protection member is mounted in said housing adjacent said connector means for movement between a safety position covering said connector means after removal of the cordless appliance input terminal and an inactive position permitting access to said connector means.

6. A connection installation according to claim 5 wherein said protection member is mounted on a safety lever pivotally mounted in said housing, said safety lever being engaged by a safety spring biasing said protection member toward said safety position and having a contact section for engaging the appliance to pivot said safety lever and to move said protection member to said inactive position.

7. A connection installation according to claim 1 wherein said reaction means comprises a magnetizable part which is adapted to move in response to a permanent magnet on the cordless appliance.

8. A connnection installation according to claim 1 wherein said connection means comprises an electrically conductive bushing for receiving a plug prong of the electric power input terminal of the cordless appliance.

9. A connection installation according to claim 8 wherein said bushing is U-shaped and widens at a top thereof.

10. A connection installation according to claim 1 wherein said contact actuating member is formed of electrically insulating material and is receivable in a cutout in a housing wall; and said reaction means comprises a magnetizable part which is adapted to move in response to a permanent magnet on the cordless appliance.

11. A connection installation according to claim 10 wherein said contact actuating member is mounted on a connection member guided for movement in a housing and coupled to said first switch spring; and said second switch spring is biased against a fixed stop in said second position.

12. A connection installation for a cordless electric appliance, comprising:

connector means for engaging and forming an electrical connection with an electric power input terminal of a cordless electric appliance;

power means providing a connection of said connector means to a supply of electrical power;

switch means, coupled between said connector means and said power means, for selectively electrically connecting and disconnecting said connector means from said power means, said switch means including first and second switch contacts relatively movable between a first position in which said contacts are engaged and a second position in which said contacts are separated;

biasing means for applying a force to bias said switch contacts towards said second position, said biasing means including first and second switch springs formed of curved strips of sheet metal coupled to said first and second switch contacts, respectively, said first switch spring comprising a tension spring connected with a connection member; and a contact actuating member, coupled to said switch contacts, for moving said switch contacts against said biasing means to said first position, said contact actuating member including magnetic reaction means for moving said contact actuating member in response to proximity of a magnet in the cordless appliance, said connection member being connected to said contact actuating member and being located adjacent said first switch contact, said contact actuating member being guided for movement in a housing, said second switch spring comprising a compression spring biased against a fixed stop in said second position.

13. A connection installation according to claim 12 wherein said first switch spring and said connection member are integral, said connection member having a guide part in said housing which is U-shaped in transverse cross section and having a flexible flange connecting said connection member to said contact actuating member, said first switch spring having a contact flange supporting said first contact and extending from said connection member, and having a flexible portion curved in an S-shape.

14. A connection installation according to claim 12 wherein said second switch spring comprises a holder part mounted in said housing and a contact part forming said connector means and formed as one piece with said holder part; and a protection member is mounted in said housing adjacent said connector means for movement between a safety position covering said connector means after removal of the cordless appliance input terminal and an inactive position permitting access to said connector means.

15. A connection installation according to claim 14 wherein said protection member is mounted on a safety lever pivotally mounted in said housing, said safety lever being engaged by a safety spring biasing said protection member toward said safety position and having a contact section for engaging the appliance to pivot said safety lever and to move said protection member to said inactive position.

16. A connection installation for a cordless electric appliance, comprising:

connector means for engaging and forming an electrical connection with an electric power input terminal of a cordless electric appliance over a certain separation distance of the electric appliance in a direction away from said connector means, said connector means comprising an electrically conductive bushing for receiving an electrically conductive plug prong of the electric power input terminal of the cordless appliance, said bushing being U-shaped and widening at a top thereof;

power means providing a connection of said connector means to a supply of electrical power;

switch means, coupled between said connector means and said power means, for selectively electrically connecting and disconnecting said connector means from said power means, said switch means including first and second switch contacts relatively movable between a first position in which said contacts are engaged and a second position in which said contacts are separated;

biasing means, coupled to said switch contacts, for applying a force to said switch contacts towards said second position; and a contact actuating member, coupled to said switch contacts, for moving said switch contacts against said biasing means to said first position, said contact actuating member including magnetic reaction means for moving said contact actuating member against said biasing means in response to proximity of a magnet in the cordless appliance, said certain separation distance being greater than a distance at which proximity of the magnet in the appliance to said magnetic reaction means is sufficent to cause said contact actuating member to move said switch contacts to said first position against the force of said biasing means as the appliance is moved toward and away from said connector means, whereby the switch contacts are in said first position only after coupling of said connector means with the electric power input terminal of the appliance and said switch contacts move to said second position while said connector means still engages the electric power input terminal of the appliance.

17. A connection installation for a cordless electric appliance, comprising:

connector means for engaging and forming an electrical connection with an electric power input terminal of a cordless electric appliance over a certain separation distance of the electric appliance in a direction away from said connector means;

power means providing a connection of said connector means to a supply of electrical power;

switch means, coupled between said connector means and said power means, for selectively electrically connecting and disconnecting said connector means from said power means, said switch means including first and second switch contacts relatively movable between a first position in which said contacts are engaged and a second position in which said contacts are separated;

biasing means, coupled to said switch contacts, for applying a force to said switch contacts towards said second position; and a contact actuating member, coupled to said switch contacts, for moving said switch contacts against said biasing means to said first position, said contact actuating member including magnetic reaction means for moving said contact actuating member against said biasing means in response to proximity of a magnet in the cordless appliance, said certain separation distance being greater than a distance at which proximity of the magnet in the appliance to said magnetic reaction means is sufficient to cause said contact actuating member to move said switch contacts to said first position against the force of said biasing means as the appliance is moved toward and away from said connector means, whereby the switch contacts are in said first position only after coupling of said connector means with the electric power input terminal of the appliance and said switch contacts move to said second position while said connector means still engages the electric power input terminal of the appliance, said contact actuating member being formed of electrically insulating material and receivable in a cutout in a housing wall, said reaction means comprising a magnetizable part which moves in response to a permanent magnet on the cordless appliance, said biasing means comprises first and second switch springs, said contact actuating member being mounted on a connection member guided for movement in a housing and coupled to said first switch spring, said first and second switch springs supporting said first and second contacts, respectively, said second switch spring being biased against a fixed stop in said second position.

* * * * *